US011338589B2

(12) United States Patent
Ikushima

(10) Patent No.: US 11,338,589 B2
(45) Date of Patent: May 24, 2022

(54) DROPLET EJECTION DEVICE AND DROPLET EJECTION METHOD

(71) Applicant: MUSASHI ENGINEERING, INC., Mitaka (JP)

(72) Inventor: Kazumasa Ikushima, Mitaka (JP)

(73) Assignee: MUSASHI ENGINEERING, INC., Mitaka (JP)

( * ) Notice: Subject to any disclaimer, the term of this patent is extended or adjusted under 35 U.S.C. 154(b) by 3 days.

(21) Appl. No.: 16/954,330

(22) PCT Filed: Dec. 17, 2018

(86) PCT No.: PCT/JP2018/046286
§ 371 (c)(1),
(2) Date: Jun. 16, 2020

(87) PCT Pub. No.: WO2019/124295
PCT Pub. Date: Jun. 27, 2019

(65) Prior Publication Data

US 2021/0078336 A1 Mar. 18, 2021

(30) Foreign Application Priority Data

Dec. 19, 2017 (JP) ..... JP2017-242785

(51) Int. Cl.
*B41J 29/38* (2006.01)
*B41J 2/18* (2006.01)
*B41J 2/175* (2006.01)

(52) U.S. Cl.
CPC ..... *B41J 2/18* (2013.01); *B41J 2/17596* (2013.01)

(58) Field of Classification Search
None
See application file for complete search history.

(56) References Cited

U.S. PATENT DOCUMENTS 8,128,212 B2 3/2012 Katada et al.
8,336,997 B2 12/2012 Katada et al.
(Continued)

FOREIGN PATENT DOCUMENTS

CN 101124094 A 2/2008
EP 2050572 A2 4/2009
(Continued)

OTHER PUBLICATIONS

Translation of International Search Report dated Mar. 12, 2019, issued in counterpart application No. PCT/JP2018/046286. (2 pages).
(Continued)

*Primary Examiner* — Erica S Lin
*Assistant Examiner* — Tracey M McMillion
(74) *Attorney, Agent, or Firm* — WHDA, LLP

(57) ABSTRACT

[Problem] To provide a droplet ejection device and a droplet ejection method with which a liquid material can be continuously delivered to an ejection head when the liquid material is delivered between arbitrary tanks. [Solution] Provided are a droplet ejection device and a droplet ejection method using the droplet ejection device, the droplet ejection device comprising a droplet ejection head; a supply tank that is in communication with a first positive pressure source; a collection tank that is in communication with a first negative pressure source; a replenishment tank that is in communication with the supply tank and the collection tank; an opening/closing valve A that opens and closes a flow passage communicating between the supply tank and the replenishment tank; an opening/closing valve B that opens and closes a flow passage communicating between the collection tank and the replenishment tank; a switching valve that switches communication between the replenishment tank and a second positive pressure source and communication between the replenishment tank and a second
(Continued)

negative pressure source; and a control device, wherein the control device has an ejection mode in which a liquid material is ejected from the droplet ejection head, a replenishment mode in which the liquid material is delivered from the replenishment tank to the supply tank while the liquid material is delivered from the supply tank to the collection tank, and a collection mode in which the liquid material is delivered from the collection tank to the replenishment tank while the liquid material is delivered from the supply tank to the collection tank.

17 Claims, 4 Drawing Sheets

(56) References Cited

U.S. PATENT DOCUMENTS

| | | | | |
|---|---|---|---|---|
| 8,506,029 | B2 | 8/2013 | Isozaki et al. | |
| 9,327,514 | B2 | 5/2016 | Nishiyama et al. | |
| 2008/0273063 | A1 | 11/2008 | Wouters et al. | |
| 2008/0297577 | A1 | 12/2008 | Wouters et al. | |
| 2009/0040249 | A1 | 2/2009 | Wouters et al. | |
| 2010/0214334 | A1* | 8/2010 | Kusunoki | B41J 29/38 347/9 |
| 2011/0221820 | A1* | 9/2011 | Shibata | B41J 2/0458 347/17 |
| 2016/0089896 | A1 | 3/2016 | Nishiyama | |
| 2016/0337713 | A1* | 11/2016 | Harrison | G06Q 30/0269 |
| 2017/0066246 | A1 | 3/2017 | Miyazawa | |
| 2017/0197431 | A1 | 7/2017 | Yamada et al. | |

FOREIGN PATENT DOCUMENTS

| | | | | |
|---|---|---|---|---|
| JP | H08215626 | A | | 8/1996 |
| JP | 2008289983 | A | | 12/2008 |
| JP | 2009028676 | A | | 2/2009 |
| JP | 2009160558 | A | | 7/2009 |
| JP | 4905411 | B2 | | 3/2012 |
| JP | 2016175186 | A | * | 10/2016 |
| JP | 2016175186 | A | | 10/2016 |
| JP | 2017018845 | A | | 1/2017 |
| JP | 2017047413 | A | | 3/2017 |
| JP | 2017217612 | A | | 12/2017 |
| TW | 200938305 | A | | 9/2009 |

OTHER PUBLICATIONS

International Preliminary Report on Patentability (Form PCT/IPEA/409) issued in counterpart International Application No. PCT/JP2018/046286 dated Nov. 29, 2019. (4 pages).

Supplementary European Search Report dated Jul. 2, 2021, issued in counterpart EP Application No. 18891703.3. (1 pages).

Office Action dated Jul. 19, 2021, issued in counterpart CN Application No. 201880082362.6, with English Translation. (12 pages).

* cited by examiner

[Fig. 1]
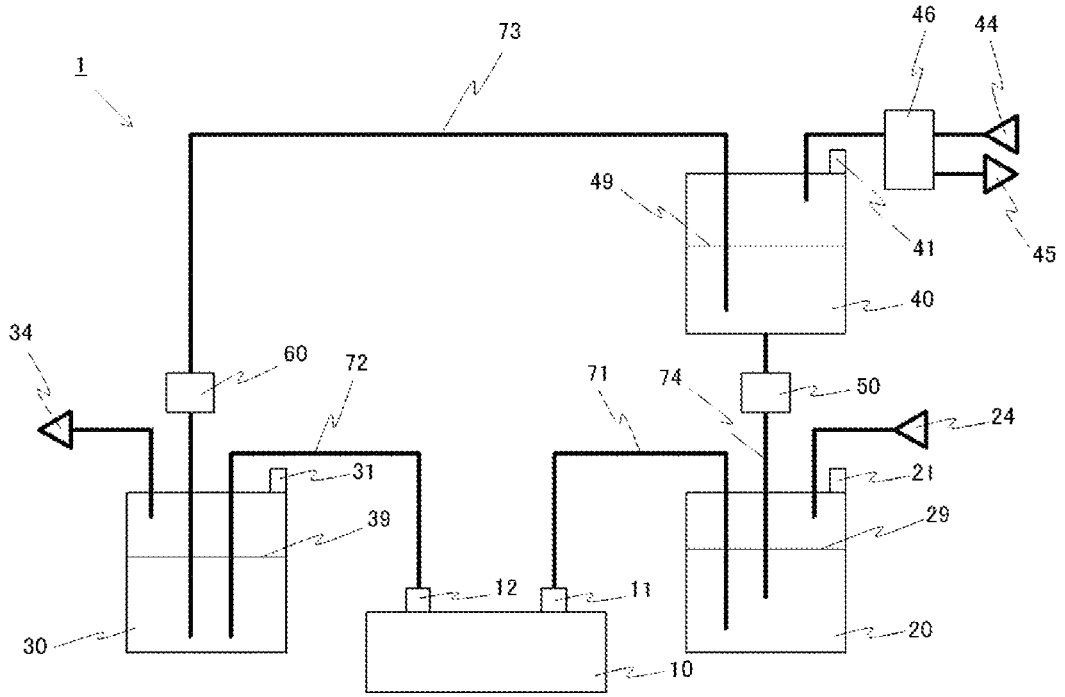
[Fig. 2]
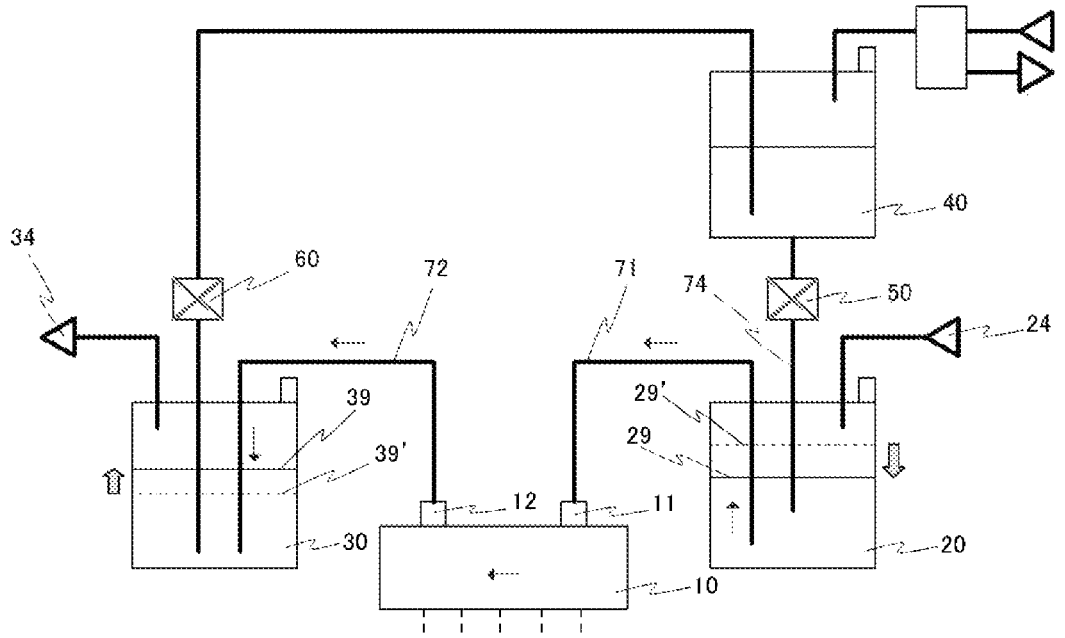

[Fig. 3]
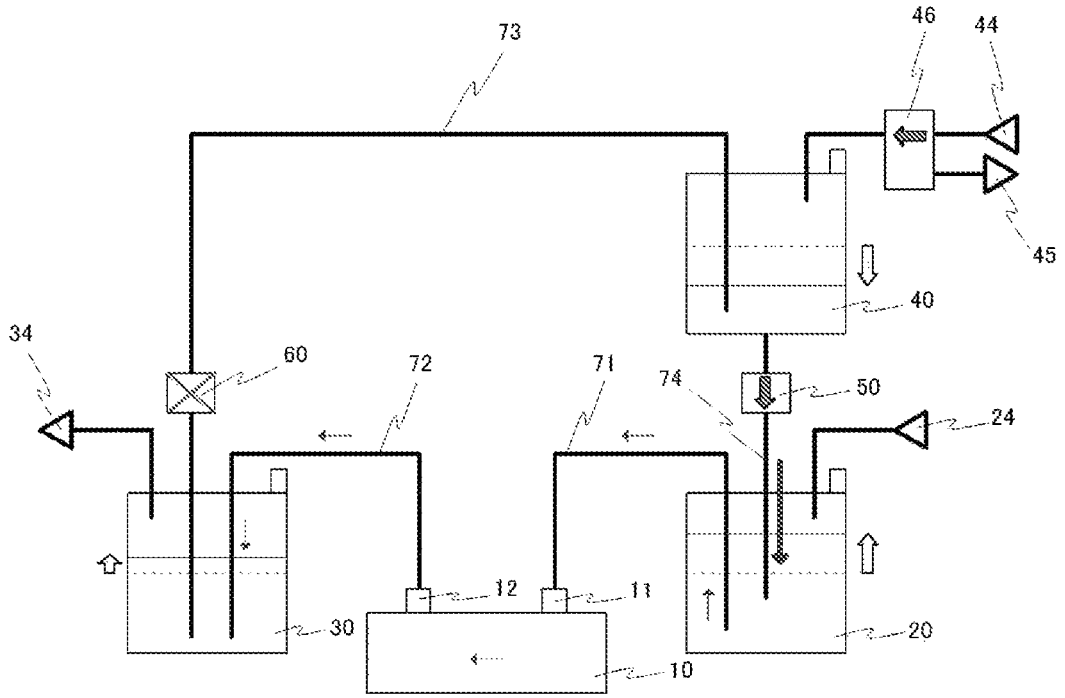
[Fig. 4]
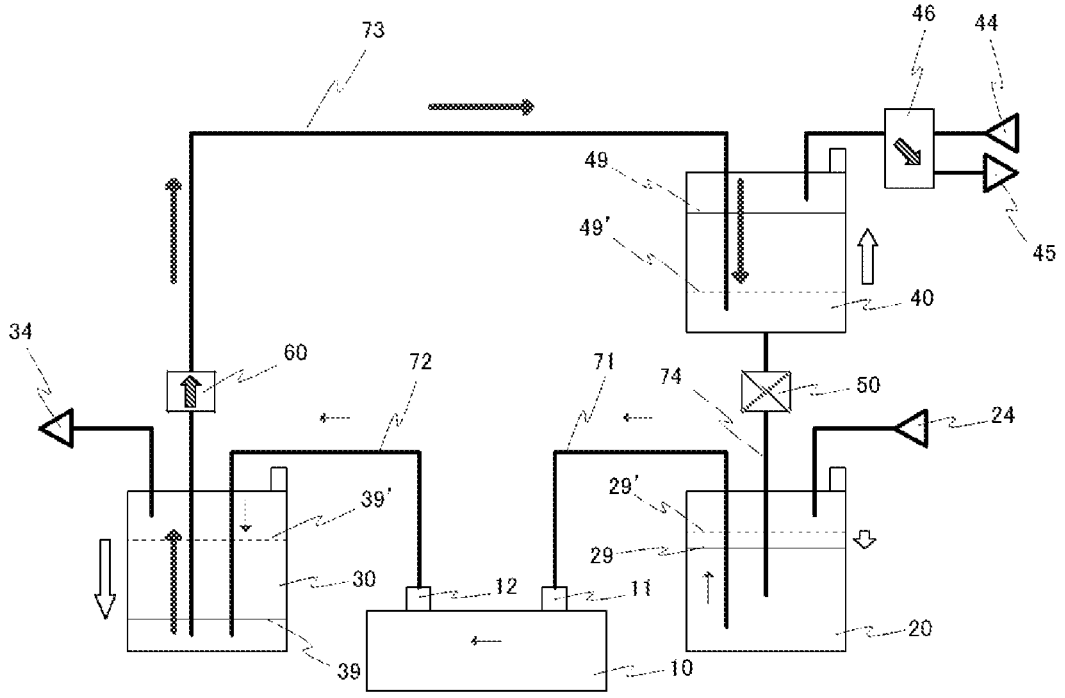

[Fig. 5]
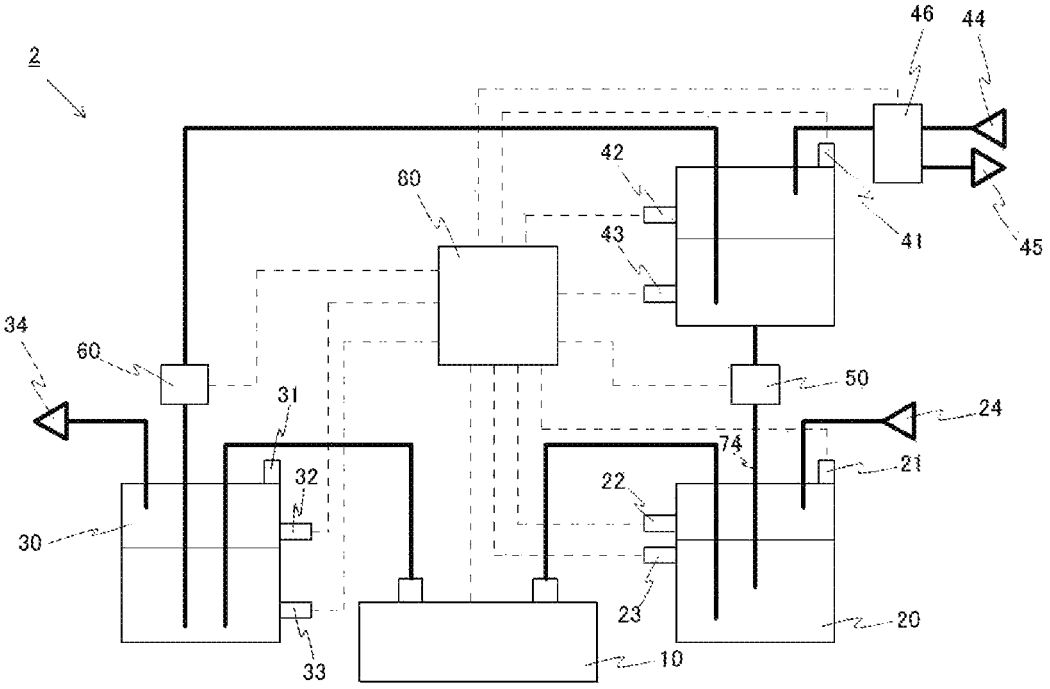

[Fig. 6]
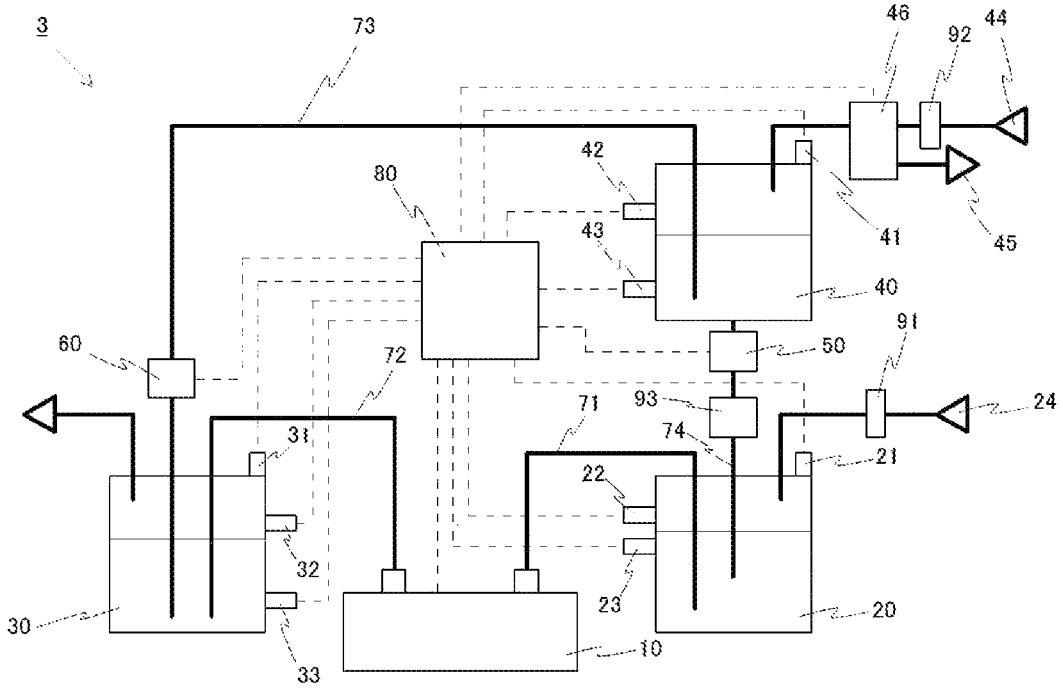

DROPLET EJECTION DEVICE AND DROPLET EJECTION METHOD

TECHNICAL FIELD

The present invention relates to a droplet ejection device equipped with a circulation mechanism, and to a droplet ejection method.

BACKGROUND ART

In the past, there has been known an inkjet recording apparatus equipped with a mechanism for circulating ink among a plurality of tanks.

For example, Patent Document 1 discloses an inkjet recording apparatus including a first tank that stores ink, an inkjet head, a second tank that is positioned between the first tank and the inkjet head and that supplies the ink to the inkjet head, and a third tank that stores the ink collected to the first tank, wherein the first tank has a mechanism for adjusting pressure in an internal space to positive pressure or atmospheric pressure, the second tank has a mechanism for adjusting pressure in an internal space to positive pressure or negative pressure, the third tank has a mechanism for adjusting pressure in an internal space to negative pressure, and a liquid level in the third tank is adjusted to locate above a liquid level of the first tank in a vertical direction.

CITATION LIST

Patent Document

Patent Document 1: Japanese Patent Laid-Open Publication No. 2016-175186

SUMMARY OF INVENTION

Technical Problem

The related-art ejection device equipped with the mechanism for circulating a liquid material (ink) among the plurality of tanks has the problem that delivery of the liquid material to the ejection head needs to be stopped in some cases when the liquid material is delivered between arbitrary tanks.

Accordingly, an object of the present invention is to provide a droplet ejection device and a droplet ejection method with which a liquid material can be continuously delivered to an ejection head when the liquid material is delivered between arbitrary tanks.

Solution to Problem

The droplet ejection device according to the present invention comprises a droplet ejection head that ejects a liquid material; a supply tank that is in communication with the droplet ejection head and a first positive pressure source; a collection tank that is in communication with the droplet ejection head and a first negative pressure source; a replenishment tank that is in communication with the supply tank and the collection tank; an opening/closing valve A that opens and closes a flow passage communicating between the supply tank and the replenishment tank; an opening/closing valve B that opens and closes a flow passage communicating between the collection tank and the replenishment tank; a switching valve having a first position at which the replenishment tank and a second positive pressure source are communicated with each other and a second position at which the replenishment tank and a second negative pressure source are communicated with each other; and a control device, wherein the control device has an ejection mode in which the opening/closing valve A is closed, the opening/closing valve B is closed, and the liquid material is ejected from the droplet ejection head while the liquid material is delivered from the supply tank to the collection tank, a replenishment mode in which the opening/closing valve A is opened, the opening/closing valve B is closed, and the liquid material is delivered from the replenishment tank to the supply tank while the liquid material is delivered from the supply tank to the collection tank, and a collection mode in which the opening/closing valve A is closed, the opening/closing valve B is opened, and the liquid material is delivered from the collection tank to the replenishment tank while the liquid material is delivered from the supply tank to the collection tank.

In the above droplet ejection device, the control device may cause the liquid material to be ejected from the droplet ejection head in the replenishment mode.

In the above droplet ejection device, the control device may cause the liquid material to be ejected from the droplet ejection head in the collection mode.

In the above droplet ejection device, the supply tank may be held at pressure higher than atmospheric pressure and the collection tank may be held at pressure lower than the atmospheric pressure in the ejection mode, the replenishment mode, and the collection mode.

In the above droplet ejection device, the control device may bring the replenishment tank into a positive pressure environment before opening the opening/closing valve A.

In the above droplet ejection device, the control device may bring the replenishment tank into a negative pressure environment before opening the opening/closing valve B.

In the above droplet ejection device, flow resistance of the flow passage between the supply tank and the collection tank may be larger than flow resistance of the flow passage between the replenishment tank and the supply tank.

In the above droplet ejection device, flow resistance of the flow passage between the supply tank and the collection tank may be larger than flow resistance of the flow passage between the collection tank and the replenishment tank.

The above droplet ejection device may further comprise a first liquid level sensor that detects a position of a liquid level in the supply tank, a second liquid level sensor that detects a position of a liquid level in the collection tank, and a third liquid level sensor that detects a position of a liquid level in the replenishment tank, wherein the control device may switch over the ejection mode, the replenishment mode, and the collection mode in accordance with values detected by the first through third liquid level sensors.

The above droplet ejection device may further comprise a gas filter downstream of each or either one of the first positive pressure source and the second positive pressure source.

The above droplet ejection device may further comprise a liquid filter in the flow passage communicating between the replenishment tank and the supply tank.

The droplet ejection method according to the present invention is a droplet ejection method using the droplet ejection device described above.

In the above droplet ejection method, the liquid material may be a liquid material containing filler.

Advantageous Effect of Invention

According to the present invention, the droplet ejection device and the droplet ejection method can be obtained with which a liquid material can be continuously delivered to the ejection head when the liquid material is delivered between arbitrary tanks.

BRIEF DESCRIPTION OF THE DRAWINGS

FIG. 1 illustrates a configuration of a droplet ejection device 1 according to a first embodiment.

FIG. 2 is an explanatory view referenced to explain an ejection mode of the droplet ejection device 1.

FIG. 3 is an explanatory view referenced to explain a replenishment mode of the droplet ejection device 1.

FIG. 4 is an explanatory view referenced to explain a collection mode of the droplet ejection device 1.

FIG. 5 illustrates a configuration of a droplet ejection device 2 according to a second embodiment.

FIG. 6 illustrates a configuration of a droplet ejection device 3 according to a third embodiment.

DESCRIPTION OF EMBODIMENTS

Embodiments for carrying out the present invention will be described below.

First Embodiment

<Configuration>

FIG. 1 illustrates a configuration of a droplet ejection device 1 according to a first embodiment.

The droplet ejection device 1 mainly includes a droplet ejection head 10, a first tank (supply tank) 20, a second tank (collection tank) 30, a third tank (replenishment tank) 40, a switching valve 46, an opening/closing valve A 50, an opening/closing valve B 60, and a control device (not illustrated).

The droplet ejection head 10 is an inkjet head including a plurality of nozzles that is formed in a bottom surface, a supply flow passage that is in communication with the plurality of nozzles, a plurality of pressure generators that is disposed in a surface of the supply flow passage on the side opposing to the nozzles, an inlet port 11 through which a liquid material is supplied to the supply flow passage, and an outlet port 12 through which the liquid material having passed through the supply flow passage is drained. The plurality of pressure generators is each constituted by, for example, a piezo device using a piezoelectric element (piezo element), or a thermal device utilizing pressure that is caused when bubbles are generated by the liquid material in the supply flow passage is heated by a heater. The droplet ejection head 10 is used in a state mounted on a relatively moving device that can move the droplet ejection head 10 relative to a workpiece.

The first tank (supply tank) 20 in communication with the droplet ejection head 10 through a first liquid delivery passage 71 is disposed upstream of the droplet ejection head 10 (on the side coming into the inlet port 11), and the second tank (collection tank) 30 in communication with the droplet ejection head 10 through a second liquid delivery passage 72 is disposed downstream of the droplet ejection head 10 (on the side outgoing from the outlet port 12).

The supply tank 20 is in communication with a first positive pressure source 24 (e.g., a pressure pump) for pressurizing a tank inner space to a level higher than atmospheric pressure. The pressure in the inner space of the supply tank 20 is measured by a first pressure sensor 21, and the tank inner space is held at pressure higher than the atmospheric pressure. A positive pressure adjustment valve for adjusting pressure in accordance with a value measured by the first pressure sensor 21 may be disposed downstream of the first positive pressure source 24. The supply tank 20 is in communication with the third tank (replenishment tank) 40, described later, via a fourth liquid delivery passage 74 and the opening/closing valve A 50.

The collection tank 30 is in communication with a first negative pressure source 34 (e.g., a vacuum pump) for depressurizing a tank inner space to a level lower than the atmospheric pressure. The pressure in the inner space of the collection tank 30 is measured by a second pressure sensor 31, and the inner space of the collection tank is held at pressure lower than the atmospheric pressure. A negative pressure adjustment valve for adjusting pressure in accordance with a value measured by the second pressure sensor 31 may be disposed upstream of the first negative pressure source 34. The collection tank 30 is in communication with the third tank (replenishment tank) 40, described later, via a third liquid delivery passage 73 and the opening/closing valve B 60.

The third tank (replenishment tank) 40 is in communication with a second positive pressure source 44 (e.g., a pressure pump) and a second negative pressure source 45 (e.g., a vacuum pump) through the switching valve 46. The switching valve 46 has a first position at which the replenishment tank 40 is communicated with the second positive pressure source 44 and a second position at which the replenishment tank 40 is communicated with the second negative pressure source 45. By bringing the switching valve 46 into the first position, pressure in an inner space of the replenishment tank 40 can be set to a level higher than the atmospheric pressure. By bringing the switching valve 46 into the second position, pressure in the inner space of the replenishment tank 40 can be set to a level lower than the atmospheric pressure. The pressure in the inner space of the replenishment tank 40 is measured by a third pressure sensor 41. A positive pressure adjustment valve and a negative pressure adjustment valve for adjusting pressure in accordance with a value measured by the third pressure sensor 41 may be disposed, respectively, downstream of the second positive pressure source 44 and the upstream of the second negative pressure source 45.

A replenishment pipe through which the liquid material is to be replenished from the outside may be connected to the replenishment tank 40.

The control device, not illustrated, is electrically connected to the droplet ejection head 10, the pressure sensors (21, 31 and 41), the switching valve 46, the opening/closing valve A 50, and the opening/closing valve B 60, and it includes a storage unit and a processing unit, the storage unit storing an ejection program to control operations of the above-mentioned components.

The above-described droplet ejection device 1 is based on the premise that one type of liquid material is used. In the case of using plural types of liquid materials, however, the plural types of liquid materials can be ejected by installing a circulation mechanism, which is constituted by the supply tank 20, the collection tank 30, the replenishment tank 40, the switching valve 46, the opening/closing valve A 50, and the opening/closing valve B 60, in the same number as the types of liquid materials. In such a case, the above-described positive pressure sources and negative pressure sources may be each shared by the plurality of circulation mechanisms.

<Operation>

The operation of the droplet ejection device 1 will be described with reference to FIGS. 2 to 4. An ejection mode, a replenishment mode, and a collection mode, described below, are automatically switched over by the control device (not illustrated).

[1] Ejection Mode

As illustrated in FIG. 2, the opening/closing valve A 50 is closed to shut off the communication between the replenishment tank 40 and the supply tank 20, and the opening/closing valve B 60 is closed to shut off the communication between the collection tank 30 and the replenishment tank 40.

Pressurized gas from the first positive pressure source 24 is supplied to the supply tank 20, and the pressure in the supply tank 20 is adjusted to positive pressure higher than the atmospheric pressure. The collection tank 30 is communicated with the first negative pressure source 34, and the pressure in the collection tank 30 is adjusted to negative pressure lower than the atmospheric pressure. Due to a pressure difference between the supply tank 20 and the collection tank 30, the liquid material stored in the supply tank 20 is forced to flow toward the collection tank 30 through the droplet ejection head 10. The droplet ejection head 10 ejects the liquid material in the form of droplets from the plurality of nozzles by the pumping action of the pressure generators. In other words, when the pressure generators in the droplet ejection head 10 are operated, a part of the liquid material flowing through the supply flow passage in the droplet ejection head is ejected through the nozzles (discharge ports) of the droplet ejection head 10.

Although the part of the liquid material having flowed out from the supply tank 20 is ejected through the nozzles of the droplet ejection head 10 as described above, the liquid material having not been ejected flows toward the collection tank 30 and is stored there. Here, the liquid material continuously flows from the supply tank 20 toward the collection tank 30 regardless of whether the pressure generators in the droplet ejection head 10 are operated or not.

In the ejection mode, because the opening/closing valve A 50 and the opening/closing valve B 60 are both closed, the interior of the replenishment tank 40 may be in a state at either positive or negative pressure. Accordingly, the switching valve 46 may be set at either the first position or the second position.

[2] Replenishment Mode

As illustrated in FIG. 2, when the liquid material continuously flows from the supply tank 20 toward the collection tank 30, a liquid level 29' (water head position) in the supply tank 20, denoted by a dotted line, gradually falls (29'→29) and a liquid level 39' (water head position) in the collection tank 30 gradually rises (39'→39).

When the liquid level 29 in the supply tank 20 falls below a certain level or when the ejection mode continues for a certain time or longer, the replenishment mode of delivering the liquid material stored in the replenishment tank 40 to the supply tank 20 is performed.

As illustrated in FIG. 3, the opening/closing valve A 50 is opened to communicate between the replenishment tank 40 and the supply tank 20, while the opening/closing valve B 60 is held closed to shut off the communication between the collection tank 30 and the replenishment tank 40. At this time, the first positive pressure source 24 and the supply tank 20 are held in the communicated state, and the first negative pressure source 34 and the collection tank 30 are also held in the communicated state.

Furthermore, the switching valve 46 is set to the first position at which the second positive pressure source 44 and the replenishment tank 40 are communicated with each other. Accordingly, the interior of the replenishment tank 40 is brought into a pressurized state at higher pressure than the atmospheric pressure. Here, pressure of gas supplied from the second positive pressure source 44 is adjusted to a level higher than the pressure supplied from the first positive pressure source 24 to the supply tank 20. As a result, the pressure in the replenishment tank 40 becomes higher than that in the supply tank 20, and the liquid material stored in the replenishment tank 40 is forced to flow into the supply tank 20 through the opening/closing valve A 50 in the opened state.

Even during execution of the replenishment mode, because the supply tank 20 and the collection tank 30 are in the communicated state and the pressure difference between the supply tank 20 and the collection tank 30 is the same as that in the ejection mode, the liquid material continuously flows from the supply tank 20 toward the collection tank 30. Hence the droplets can be ejected from the droplet ejection head 10.

Assuming that the pressure in the supply tank 20 is called first pressure, the pressure in the collection tank 30 is called second pressure, and the pressure in the replenishment tank 40 is called third pressure, a relation in levels of those three pressures is expressed by third pressure>first pressure>second pressure. Here, the second pressure is lower than the atmospheric pressure, but the first pressure and the third pressure are higher than the atmospheric pressure.

By setting the above-described relation in pressure difference to be satisfied among the three tanks (20, 30 and 40), the liquid material can be forced to flow from the supply tank 20 to the collection tank 30 while the liquid material is replenished from the replenishment tank 40 to the supply tank 20. In other words, even during the replenishment mode, it is possible to maintain a state (continuous circulation) in which the liquid material continuously flows through the supply flow passage in the droplet ejection head 10 disposed between the supply tank 20 and the collection tank 30. On that occasion, because the opening/closing valve B 60 disposed between the replenishment tank 40 and the collection tank 30 is in the closed state, the liquid material does not flow from the replenishment tank 40 to the collection tank 30 through the third liquid delivery passage 73.

The fourth liquid delivery passage 74 extending from the replenishment tank 40 to the supply tank 20 is constituted such that the liquid material flows more easily through the fourth liquid delivery passage 74 than through a flow passage (including 10, 71 and 72) extending from the supply tank 20 to the collection tank 30. In other words, the fourth liquid delivery passage 74 has smaller flow resistance than the flow passage constituted by the first liquid delivery passage 71, the droplet ejection head 10, and a second liquid delivery passage 72. A flow control valve may be disposed in the first liquid delivery passage 71 or the second liquid delivery passage 72 in order to realize the above-mentioned relation in flow resistance. Such a feature ensures a relation that an amount of the liquid material delivered from the supply tank 20 to the collection tank 30 is always kept smaller than an amount (filled amount) of the liquid material delivered from the replenishment tank 40 to the supply tank 20.

It is preferable to bring the replenishment tank 40 into the pressurized state for preparation to start the replenishment by setting the switching valve 46 to the first position before opening the opening/closing valve A 50. That preparation enables an operation of filling the liquid material to the supply tank 20 to be started at once upon the opening of the opening/closing valve A 50.

[3] Collection Mode

As described above regarding the operation in the replenishment mode, when the liquid material continuously flows from the supply tank 20 toward the collection tank 30, the liquid level 29 (water head position) in the supply tank 20 gradually falls (29'→29) and the liquid level 39 (water head position) in the collection tank 30 gradually rises (39'→39). When the liquid level 39 in the collection tank 30 rises above a certain level or when the ejection mode continues for a certain time or longer, the collection mode of delivering the liquid material stored in the collection tank 30 to the replenishment tank 40 is performed.

As illustrated in FIG. 4, the opening/closing valve A 50 is closed to shut off the communication between the replenishment tank 40 and the supply tank 20, while the opening/closing valve B 60 is opened to communicate between the collection tank 30 and the replenishment tank 40. At this time, the first positive pressure source 24 and the supply tank 20 are held in the communicated state, and the first negative pressure source 34 and the collection tank 30 are also held in the communicated state.

Furthermore, the switching valve 46 is set to the second position at which the second negative pressure source 45 and the replenishment tank 40 are communicated with each other. Accordingly, the interior of the replenishment tank 40 is brought into a depressurized state at pressure lower than the atmospheric pressure. Here, negative pressure supplied from the second negative pressure source 45 is adjusted to a level lower than the negative pressure supplied from the first negative pressure source 34 to the collection tank 30. As a result, the pressure in the replenishment tank 40 becomes lower than that in the collection tank 30, and the liquid material stored in the collection tank 30 is forced to flow into the replenishment tank 40 through the opening/closing valve B 60 in the opened state.

Even during execution of the collection mode, because the supply tank 20 and the collection tank 30 are in the communicated state and the pressure difference between the supply tank 20 and the collection tank 30 is the same as that in the ejection mode, the liquid material continuously flows from the supply tank 20 toward the collection tank 30. Hence the droplets can be ejected from the droplet ejection head 10.

During the collection mode, the tank pressures are held in such a relation that the pressure in the supply tank 20 is higher than the atmospheric pressure, the pressure in the collection tank 30 is lower than the atmospheric pressure, and the pressure in the replenishment tank 40 is lower than the pressure in the collection tank 30. Therefore, the liquid material flows through the supply tank 20, the collection tank 30, and the replenishment tank 40 in the mentioned order. On that occasion, because the opening/closing valve A 50 is in the closed state, the liquid material does not flow from the supply tank 20 to the replenishment tank 40 through the fourth liquid delivery passage 74.

The third liquid delivery passage 73 extending from the collectiontank 30 to the replenishment tank 40 is constituted such that the liquid material flows more easily through the third liquid delivery passage 73 than through the flow passage (including 10, 71 and 72) extending from the supply tank 20 to the collection tank 30 through the droplet ejection head 10. In other words, the third liquid delivery passage 73 has smaller flow resistance than the flow passage constituted by the first liquid delivery passage 71, the droplet ejection head 10, and the second liquid delivery passage 72. A flow control valve may be disposed in the first liquid delivery passage 71 or the second liquid delivery passage 72 in order to realize the above-mentioned relation in flow resistance. Such a feature ensures a relation that an amount (feed amount) of the liquid material delivered from the supply tank 20 to the collection tank 30 is always kept smaller than an amount (collected amount) of the liquid material delivered from the collection tank 30 to the replenishment tank 40.

It is preferable to bring the replenishment tank 40 into the negative pressure state for preparation to start the collection by setting the switching valve 46 to the second position before opening the opening/closing valve B 60. That preparation enables an operation of delivering the liquid material in the collection tank 30 to be started at once upon the opening of the opening/closing valve B 60.

The relations among the states of the valves and the pressures in the tanks per mode are listed in Table 1.

TABLE 1

| | Ejection Mode | Replenishment Mode | Collection Mode |
|---|---|---|---|
| Opening/closing Valve A | closed | open | closed |
| Opening/closing Valve B | closed | closed | open |
| Switching Valve | positive or negative pressure side | positive pressure side (first position) | negative pressure side (second position) |
| Supply Tank | positive pressure | positive pressure | positive pressure |
| Collection Tank | negative pressure | negative pressure | negative pressure |
| Replenishment Tank | positive or negative pressure | positive pressure (strong) | negative pressure (strong) |

With the above-described droplet ejection device 1 according to the first embodiment, even during the execution of the replenishment mode or the collection mode, it is possible to flow the liquid material into the droplet ejection head 10 and to eject the droplets. Although, in Patent Document 1, the circulation of ink and the operation of ejecting the ink have to be stopped when replenishing the ink, the ejection operation can be continuously performed in the present invention even in the replenishment mode and the collection mode.

Furthermore, because switching between positive and negative pressures is not performed during the replenishment mode and the collection mode in relation to the supply tank 20 and the collection tank 30 that are directly coupled to the droplet ejection head 10, the replenishment mode and the collection mode can be each executed in a short time without consuming an extra time for reversal between the positive and negative pressures. In other words, by timely performing the replenishment mode and the collection mode in an interval time between the successive ejection operations, the position of the liquid level (i.e., the water head position) in the supply tank 20 can be held within a certain range, and hence the ejection can be performed with high accuracy. In Patent Document 1, because the ink cannot be replenished unless the pressure in the tank directly coupled to the inkjet head is reversed between positive and negative levels, a problem arises in that a time required for replenishing the ink is prolonged and an additional time is taken for adjustment of the pressure in the tank.

Furthermore, since gas pressure is utilized to flow the liquid material, there is no possibility of mixing of dust and chips of parts, which are generated by abrasion and wear when a mechanical power source such as a pump is used, and the liquid material can be used in a clean state.

In addition, since the liquid material can be always stirred by circulating the liquid material at all times, the droplet ejection device 1 is particularly suitable for the operation of ejecting the liquid material that contains precipitate-generating particles (including flake-like particles), such as filler.

Second Embodiment

FIG. 5 illustrates a configuration of a droplet ejection device 2 according to a second embodiment.

Components denoted by the same reference signs as in the first embodiment are the same as in the first embodiment, and hence description of those components is omitted. The droplet ejection device 2 according to the second embodiment is different from the droplet ejection device 1 according to the first embodiment in including a first liquid level sensor A 22, a first liquid level sensor B 23, a second liquid level sensor A 32, a second liquid level sensor B 33, a third liquid level sensor A 42, and a third liquid level sensor B 43. For convenience of explanation, FIG. 5 representing the second embodiment illustrates a control device 80 as well although the control device equipped in the first embodiment is not illustrated.

As illustrated in FIG. 5, the control device 80 is electrically connected to the droplet ejection head 10, the pressure sensors (21, 31 and 41), the liquid level sensors (22, 23, 32, 33, 42 and 43), the switching valve 46, the opening/closing valve A 50, and the opening/closing valve B 60, and it includes a storage unit and a processing unit, the storage unit storing an ejection program to control operations of the above-mentioned components.

The control device 80 switches over the ejection mode, the replenishment mode, and the collection mode in accordance with values measured by the liquid level sensors (22, 23, 32, 33, 42 and 43). For the supply tank 20, the liquid level is controlled so as to position within a certain range in order to suppress variations in accuracy of an ejection amount. More specifically, when the liquid level in the supply tank 20 falls below the first liquid level sensor B 23, the replenishment mode is executed, and at the time when the first liquid level sensor A 22 detects a rise of the liquid level, the mode is switched from the replenishment mode to the ejection mode or the collection mode.

For the collection tank 30, control is performed such that the liquid material will not overflow from the collection tank 30 or that the collection tank 30 will not be emptied. More specifically, when the liquid level in the collection tank 30 rises above the second liquid level sensor A 32, the collection mode is executed, and at the time when the second liquid level sensor B 33 detects a fall of the liquid level, the mode is switched from the collection mode to the ejection mode or the replenishment mode. When the mode is switched to the collection mode, it is preferable to bring the replenishment tank 40 into the negative pressure state for preparation to start the collection by setting the switching valve 46 to the second position before opening the opening/closing valve B 60.

For the replenishment tank 40, control is performed such that the replenishment tank 40 will not be emptied or that the liquid material will not overflow from the replenishment tank 40. More specifically, when the liquid level in the replenishment tank 40 falls below the third liquid level sensor B 33, the collection mode is executed, and at the time when the third liquid level sensor A 33 detects a rise of the liquid level, the mode is switched from the collection mode to the ejection mode or the replenishment mode. When the mode is switched to the replenishment mode, it is preferable to bring the replenishment tank 40 into the pressurized state for preparation to start the replenishment by setting the switching valve 46 to the first position before opening the opening/closing valve A 50.

As described above, the control for the position of the liquid level, performed by the control device 80, has different technical meanings for the supply tank 20, the collection tank 30, and the replenishment tank 40.

With the above-described droplet ejection device 2 according to the second embodiment, since the ejection mode, the replenishment mode, and the collection mode are switched over in accordance with the values measured by the liquid level sensors (22, 23, 32, 33, 42 and 43), the position of the liquid level (i.e., the water head position) in the supply tank 20 can be controlled with higher accuracy, and hence the ejection can be performed with higher accuracy.

Third Embodiment

FIG. 6 illustrates a configuration of a droplet ejection device 3 according to a third embodiment.

Components denoted by the same reference signs as in the second embodiment are the same as in the second embodiment, and hence description of those components is omitted. The droplet ejection device 3 according to the third embodiment is different from the droplet ejection device 2 according to the second embodiment in including gas filters 91 and 92 and a liquid filter 93.

In the third embodiment, the gas filter 91 is disposed downstream of the first positive pressure source 24, and the gas filter 92 is disposed downstream of the second positive pressure source 44. However, the gas filter may be disposed downstream of only one of those two positive pressure sources.

The above-described droplet ejection device 3 according to the third embodiment can realize a cleaner ejection environment because of including the gas filters 91 and 92 and the liquid filter 93.

While the preferred embodiments of the present invention have been described above, the technical scope of the present invention is not limited to the above-described embodiments. The above-described embodiments can be variously modified and improved, and the modified and improved embodiments also fall within the technical scope of the present invention. For example, the droplet ejection head is not limited to the inkjet head, and the present invention can be further applied to a needle-type dispenser in which the liquid material is ejected from a nozzle by relatively moving a valve seat and a rod tip away from each other.

LIST OF REFERENCE SIGNS

1 droplet ejection device (first embodiment)
2 droplet ejection device (second embodiment)
3 droplet ejection device (third embodiment)
10 droplet ejection head
11 inlet port
12 outlet port
20 first tank (supply tank)
21 first pressure sensor
22 first liquid level sensor A
23 first liquid level sensor B
24 first positive pressure source

29 liquid level in first tank
30 second tank (collection tank)
31 second pressure sensor
32 second liquid level sensor A
33 second liquid level sensor B
34 first negative pressure source
39 liquid level in second tank
40 third tank (replenishment tank)
41 third pressure sensor
42 third liquid level sensor A
43 third liquid level sensor B
44 second positive pressure source
45 second negative pressure source
46 switching valve
49 liquid level in third tank
50 opening/closing valve A
60 opening/closing valve B
71 first liquid delivery passage
72 second liquid delivery passage
73 third liquid delivery passage
74 fourth liquid delivery passage
80 control device
91, 92 gas filter
93 liquid filter

The invention claimed is:

1. A droplet ejection device comprising:

a droplet ejection head that ejects a liquid material;

a supply tank that is in communication with the droplet ejection head and a first positive pressure source;

a collection tank that is in communication with the droplet ejection head and a first negative pressure source;

a replenishment tank that is in communication with the supply tank and the collection tank;

an opening/closing valve A that opens and closes a flow passage communicating between the supply tank and the replenishment tank;

an opening/closing valve B that opens and closes a flow passage communicating between the collection tank and the replenishment tank;

a switching valve having a first position at which the replenishment tank and a second positive pressure source are communicated with each other and a second position at which the replenishment tank and a second negative pressure source are communicated with each other; and a control device, wherein the control device has an ejection mode in which the opening/closing valve A is closed, the opening/closing valve B is closed, and the liquid material is ejected from the droplet ejection head while the liquid material is delivered from the supply tank to the collection tank;

a replenishment mode in which the opening/closing valve A is opened, the opening/closing valve B is closed, and the liquid material is delivered from the replenishment tank to the supply tank while the liquid material is delivered from the supply tank to the collection tank; and a collection mode in which the opening/closing valve A is closed, the opening/closing valve B is opened, and the liquid material is delivered from the collection tank to the replenishment tank while the liquid material is delivered from the supply tank to the collection tank.

2. The droplet ejection device according to claim 1, wherein the control device causes the liquid material to be ejected from the droplet ejection head in the replenishment mode.

3. The droplet ejection device according to claim 1, wherein the control device causes the liquid material to be ejected from the droplet ejection head in the collection mode.

4. The droplet ejection device according to claim 1, wherein the supply tank is held at pressure higher than atmospheric pressure and the collection tank is held at pressure lower than the atmospheric pressure in the ejection mode, the replenishment mode, and the collection mode.

5. The droplet ejection device according to claim 4, wherein the control device brings the replenishment tank into a positive pressure environment before opening the opening/closing valve A.

6. The droplet ejection device according to claim 4, wherein the control device brings the replenishment tank into a negative pressure environment before opening the opening/closing valve B.

7. The droplet ejection device according to claim 1, wherein flow resistance of the flow passage between the supply tank and the collection tank is larger than flow resistance of the flow passage between the replenishment tank and the supply tank.

8. The droplet ejection device according to claim 1, wherein flow resistance of the flow passage between the supply tank and the collection tank is larger than flow resistance of the flow passage between the collection tank and the replenishment tank.

9. The droplet ejection device according to claim 1, further comprising a first liquid level sensor that detects a position of a liquid level in the supply tank, a second liquid level sensor that detects a position of a liquid level in the collection tank, and a third liquid level sensor that detects a position of a liquid level in the replenishment tank, wherein the control device switches over the ejection mode, the replenishment mode, and the collection mode in accordance with values detected by the first through third liquid level sensors.

10. The droplet ejection device according to claim 1, further comprising a gas filter downstream of each or either one of the first positive pressure source and the second positive pressure source.

11. The droplet ejection device according to claim 1, further comprising a liquid filter in the flow passage communicating between the replenishment tank and the supply tank.

12. The droplet ejection device according to claim 1, wherein, in the replenishment mode, pressure in the replenishment tank is brought into a state higher than pressure in the supply tank such that the liquid material is delivered from the replenishment tank to the supply tank while the liquid material is delivered from the supply tank to the collection tank, and in the collection mode, the pressure in the replenishment tank is brought into a state lower than pressure in the collection tank such that the liquid material is delivered from the collection tank to the replenishment tank while the liquid material is delivered from the supply tank to the collection tank.

13. The droplet ejection device according to claim 1, wherein a liquid delivery device using mechanical power is not disposed in any of the flow passage communicating between the supply tank and the replenishment tank and the flow passage communicating between the collection tank and the replenishment tank.

14. A droplet ejection method using the droplet ejection device according to claim 1.

15. The droplet ejection method according to claim 14, wherein the liquid material is a liquid material containing filler.

16. The droplet ejection device according to claim 1, wherein the switching valve is connected to the replenishment tank, and connected to the second positive pressure source and the second negative pressure source, at the first position of the switching valve, the replenishment tank and the second positive pressure source are communicated with each other through the switching valve, and at the second position of the switching valve, the replenishment tank and the second negative pressure source are communicated with each other through the switching valve, wherein in the replenishment mode of the control device, the switching valve is at the first position, and the liquid material is delivered from the replenishment tank to the supply tank while the liquid material is delivered from the supply tank to the collection tank, and in the collection mode of the control device, the switching valve is at the second position, and the liquid material is delivered from the collection tank to the replenishment tank while the liquid material is delivered from the supply tank to the collection tank.

17. The droplet ejection device according to claim 1, wherein, in the ejection mode, pressure in the supply tank is brought into a state of higher pressure than pressure in the collection tank such that the liquid material is ejected from the droplet ejection head while the liquid material is delivered from the supply tank to the collection tank.

* * * * *